US006038795A

United States Patent [19]

Navarro

[11] Patent Number: 6,038,795

[45] Date of Patent: Mar. 21, 2000

[54] DREDGER WITH LOCKABLE REAR DOOR

[76] Inventor: Pablo Navarro, RR2 Box 6361, Cidra, Puerto Rico 00739

[21] Appl. No.: 09/064,263

[22] Filed: Apr. 22, 1998

[51] Int. Cl.[7] ..... E02F 3/34; E02F 3/48; E02F 3/52; B61C 3/00; B66B 17/00

[52] U.S. Cl. ..... 37/341; 37/394; 37/396; 37/401; 294/68.22; 172/26.5; 414/570; 414/571; 414/575; 414/582

[58] Field of Search ..... 37/195, 340, 341, 37/342, 394, 396, 401; 294/68.22; 172/26.5; 414/570, 571, 572, 575, 576, 582

[56] References Cited

U.S. PATENT DOCUMENTS

| | | | |
|---|---|---|---|
| 524,028 | 8/1894 | McMahon | 37/394 |
| 1,580,673 | 4/1926 | Page | 37/396 |
| 1,664,940 | 4/1928 | Page | 37/396 |
| 2,648,918 | 8/1953 | Mazzella | 37/394 |
| 3,488,036 | 1/1970 | Feger et al. | 294/68.22 |
| 3,556,317 | 1/1971 | Vidal | 214/10 |
| 3,643,285 | 2/1972 | Modrey | 15/246.5 |
| 4,112,602 | 9/1978 | Kato et al. | 37/55 |
| 4,370,713 | 1/1983 | McCoy, J r. et al. | 364/424 |

*Primary Examiner*—Thomas B. Will
*Assistant Examiner*—Gary S. Hartmann
*Attorney, Agent, or Firm*—Nils H. Ljungman & Associates

[57] ABSTRACT

A dredge having substantially a box-like shape, with an open front face and an open rear face, the rear face having a door hinged thereto and a lock member to hold the door in a locked position. An A-shaped frame member is pivotally secured to the front end of the dredge. Pivotable motion of the A-frame raises the front edge of the dredge over an obstruction. A pulley assembly is secured to the rear top end of the dredge, and a cable from the A-frame is placed over the pulley when the A-frame is to be pivoted to raise the dredge. A door is hinged to the rear side of the dredge. A locking hinge is secured to the rear of the dredge to lock the door in a closed position. The locking hinge includes a pivoting edge, which engages the top edge of the door, and a rectangular bar secured under the locking hinge. The rectangular bar has a width greater than the height so that rotation of the bar produces a pivoting motion of the locking hinge to unlock the door. In operation, the dredge is pulled along a surface by a cable connected to the A-frame, and when an obstacle is encountered by the dredge, the A-frame is pivoted into a vertical position to raise the front end of the dredge. The dredge is then pulled over the obstacle, and the A-frame is pivoted back to the horizontal position to resume dredging.

11 Claims, 5 Drawing Sheets

DREDGER WITH LOCKABLE REAR DOOR

BACKGROUND OF THE INVENTION

1. Field of the Invention

The present invention relates to a dredging apparatus used for removing soil from a bottom of a river or lake.

2. Background of the Prior Art

Dredges having a box-like shape with a transversely extending dredging lip along its forward bottom edge and with a rearward and transversely disposed gate pivotally mounted from its rearward upper end are well known in the art. The dredging apparatus of the Hanks patent (U.S. Pat. No. 4,028,821) includes a pivoting gate mounted on the rear of the oyster shell dredge. The sludge scraper apparatus in the Haag patent (U.S. Pat. No 5,250,199) shows a sludge scrapper which uses a first tow line to pull the scrapper blade across a surface. A second tow line located on the opposite side of the reservoir and in an opposite direction to the first tow line is used to pull the scrapper back and in an opposite direction from the first tow line.

SUMMARY OF THE INVENTION

The dredging apparatus of the present invention is a rectangular-shaped cage having a dimension of substantially 12 feet in length, 9 feet in width, and 3 feet in height, and with an open front end and a hinged rear end. The opened front end includes a pointed blade attached to the front side of the bottom of the dredge, while the rear end includes a door hinged to the dredge with a plurality of holes therein to allow water to escape. The dredge is pulled along a surface by a cable, and lifted to a position to dump the contents. When ready to dump, the hinged rear door is opened to release the contents. To re-close the hinged door, the dredge is positioned over the ground and lowered such that the weight of the dredge in contact with the ground will close the door.

The dredge is pulled along by a cable attached to a pivotable A-frame mounted toward the front of the dredge. When a rock or the like obstructs the dredge, the cable is placed over a pulley mounted toward the rear of the dredge so that the A-frame is lifted upward when the cable is pulled. Upward lifting of the A-frame causes the front end of the dredge to be lifted off of the surface so that the dredge can be pulled over the obstruction. Two shoes are placed along side the dredge so that the shoes can support the A-frame as the A-frame is pivoted.

A hinged door is secured on the rear side of the dredge, and held in a locked position by a hinged member having a tip that engages a groove portion on the door. A rectangular-shaped bar is pivoted to raise the hinged member so that the door can be unlocked and opened.

A special pulley arrangement is secured to the top of the dredge near the rear. The pulley guides the cable attached to the A-frame, and can be raised in order to remove the cable from the pulley. When the A-frame is not being used to lift the front end of the dredge, the A-frame cable is not placed over the pulley.

DETAILED DESCRIPTION

The dredge device 10 of the present invention is used to scoop up soil from any environment either in or out of water. The primary dredging operation is intended for a water environment such as riverbeds or shipping channels. The dredge 10 is substantially box-shaped in which a front end is opened while the bottom end is hinged by a door 14 which can be locked in a closed position or pivoted open to allow for the contents of the dredge to be discharged. The dredge 10 is enclosed by a top side, a bottom side, a left side, and a right side. The dimensions are approximately twelve feet in length by eight feet in width by three to four feet in height.

Figure 12:
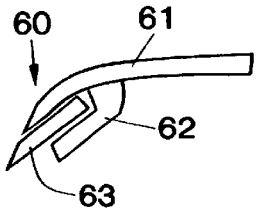
FIG. 12 shows a blade secured to the front end of the dredge.

The front edge of the dredge includes a blade member 63 (FIG. 12) used to scrape the surface that is being dredged. The blade 63 extends across the mouth or opening of the front side of the dredge, and is secured to the bottom plate 61 of the dredge by bolts or screws. A blade mounting plate 62 is welded to the underside of the bottom plate 61, and includes a plurality of holes in which the blade 63 can be secured to the front end. The blade 63 is made of a hard metal such as steel, and is ½ inch thick, six inches deep, and extends the width of the front opening of the dredge 10.

Figure 6:
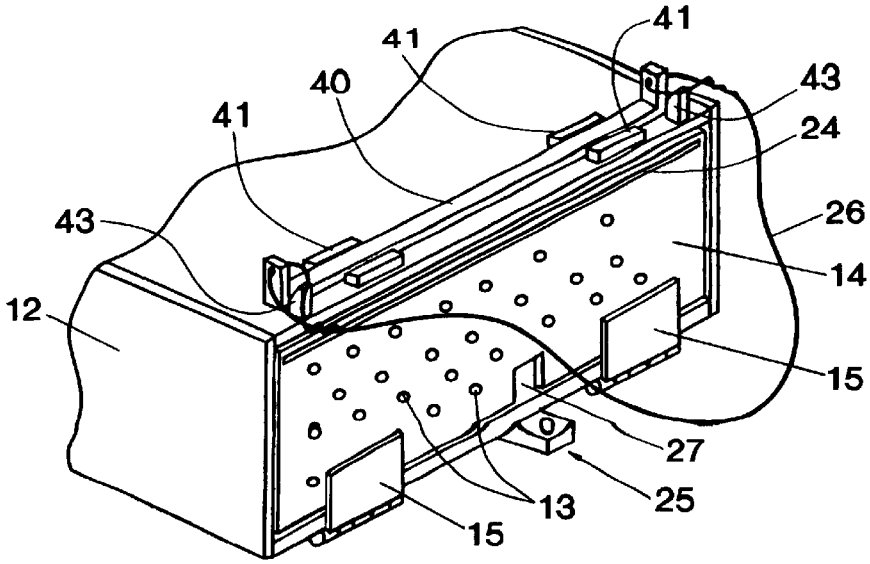
FIG. 6 shows a rear view of the dredge with the door and a mechanism used to unlock the door.

The rear end of the dredge includes a door 14, which is pivotally mounted to the dredge as shown in FIG. 6. The door includes a series of holes 13 therein, which allow for water to escape when the dredge scoops up soil having a heavy water content. The holes are one to two inches in diameter. A plurality of holes can also be added to the rear portions of the right and left sides and top and bottom sides of the dredge to allow water to escape. The sizes of the holes are generally about one and one-half inch in diameter but could be larger or smaller depending on the type of soil to be extracted.

Figure 7:
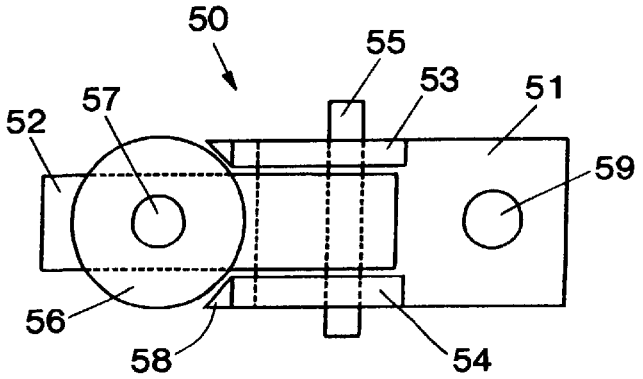
FIG. 7 shows a top view of the pulley assembly used to guide the A-frame cable.
Figure 8:
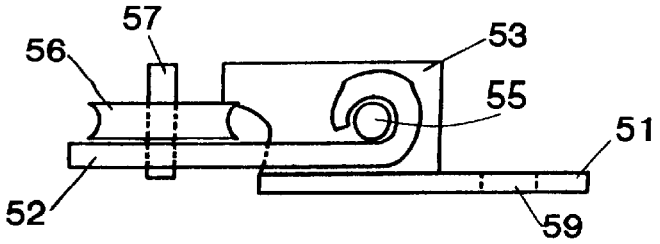
FIG. 8 shows a side view of the pulley assembly.

An A-frame 17 is pivotally secured to the sides of the dredge 10 by pins 19. The pins are secured to the sides of the dredge, while the A-frame includes holes in which the pins 19 engage. A hook member 21 is mounted to the front end of the A-frame 17, and a cable 28 is secured to the hook 21. Cable 28 is used to pull the dredge along a surface. A pulley assembly 50 is mounted to a topside of the dredge 10 near the rear end. The pulley assembly 50 is shown in detail in FIGS. 7 and 8. A bottom plate 51 is secured to the top surface of the dredge. A pivot plate 52 is pivotally mounted by a pin 55 to side walls 53 and 54 of the bottom plate 51. The pin 55 can include conventional means to such as locking pins (not shown) to secure the pin in place. A pulley 56 is mounted on a pin bearing 57 secured to the pivot plate 52. The pivot plate 52 can pivot with a respect the bottom plate 51 about the pin 55. The side walls 53 and 54 include angled portions 58 at the front end near the pulley 56. The angled portions 58 act as guides to prevent the cable 28 from coming off of the pulley 56 when the pivot plate 52 is laying on the bottom plate as shown in FIG. 8. To remove the cable 28 from the pulley, the pivot plate 52 is raised off of the bottom plate so that the angled portions 58 are no longer preventing the cable 28 from being removed off the pulley 56.

Figure 1:
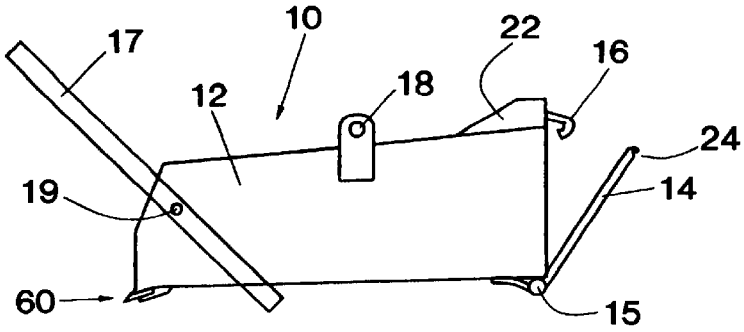
FIG. 1 shows a side view of the dredge device with the rear door hinged to the dredge and partially opened.
Figure 2:
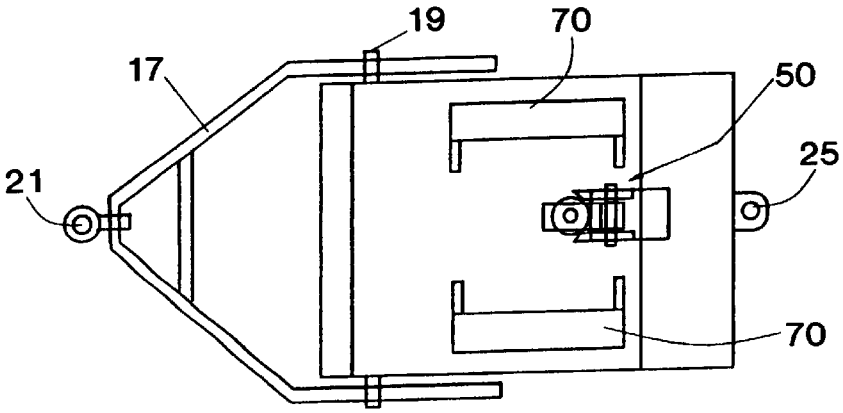
FIG. 2 shows a top view of the dredge device with the A-frame and pulley assembly.
Figure 3:
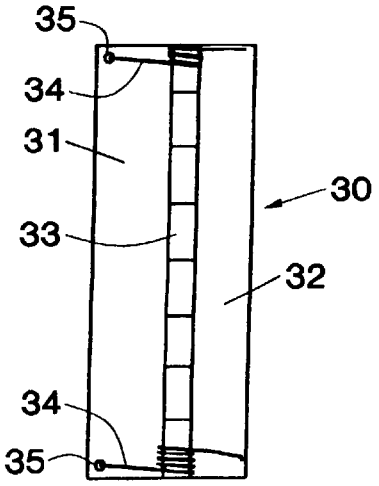
FIG. 3 shows a hinge member used to pivotally secure the locking member to the dredge.
Figure 4:
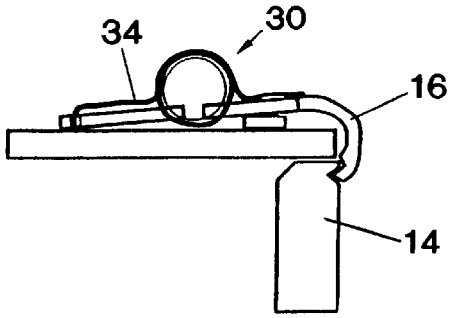
FIGS. 4 and 5 show details of the door locking mechanism.
Figure 5:
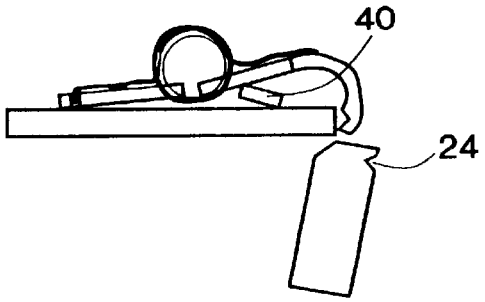

Hinges 15 secure the door 14 to the rear end of the dredge 10. Two hinges are used, but one hinge extending along the width of the door can also be used. The hinges 15 are mounted to the bottom side of the dredge by conventional means, and welded to the backside of the door 14. A latching member 16 holds the door 14 in a locked position. The latching member 16 extends substantially across the width of the rear end of the dredge 10. The latching member 16 forms part of a door locking hinge assembly 30 as shown in FIGS. 3–5. The hinge assembly 30 includes two plates 31 and 32 hinged together by a solid bar passing though the engaging portions of both plates 31 and 32 to form a hinge 33. The hinge is typical of a door hinge, but on a much larger scale. Springs 34 are used to bias the hinge in one direction. One end of the spring 34 is secured in a hole 35 formed at an end of one of the plates forming the hinge. The other end of the spring 34 rests against the other plate forming the hinge. The rear plate 32 of the hinge can include a curved portion extending downward from the top rear end of the dredge 10. The curved portion forms a locking plate 16, which extends the width of the hinge assembly. The locking plate 16 includes a tip extending across the entire width. The tip engages a groove 24 formed in the top portion of the door 14. The groove 24 prevents the tip of the locking plate 16 from slipping out. An unlocking bar 40 is held in place between the rear plate 32 of the locking hinge assembly 30 and the top surface of the dredge 10. Bushings 41 as shown in FIG. 6 are welded to the dredge, and guide the unlocking bar 40. The unlocking bar 40 is rectangular in cross sectional shape, and has arms extending upward from each end. Holes formed in the arms allow for a cable or a rigid bar to be connected such that pulling of the cable will pivot the bar, and thus raise the locking hinge 30 against the bias of a spring 34. The width of the unlocking bar 40 is larger than the height. A stop plate 43 is secured to the dredge at each side and near the arms of the rectangular bar 40. The stop plate 43 limits the pivoting motion of the rectangular bar 40. An unlocking cable 26 is connected to the unlocking bar 40 at the holes in the arms. When the unlocking bar 40 pivots, the rear plate 32 of the locking hinge assembly 30 is raised and the locking plate 16 is pivoted above the door 14 as shown in FIG. 5. At this stage, the door 14 can be opened. Pulling on the unlocking cable 26 causes the unlocking bar 40 to be pivoted. The springs 34 bias the locking plate 16 into the locking position shown in FIG. 4. The outside bottom surface of the locking plate 16 can include a beveled portion. When the door is closed, the engaging edge of the door will push up against the beveled portion of the locking plate 16 and force the locking plate up so that the door is closed and locked. A locking hinge assembly plate 22 covers the locking hinge assembly 30 (see FIG. 1). The cover plate 22 fits over the hinge assembly 30 outside of the arms of the rectangular bar 40 and stop plates 43, and forms a restraint to prevents the rectangular bar from sliding over the sides of the dredge.

A hook member 18 is secured to the top of the dredge on both sides. A lifting cable 27 is connected to the top hooks 18 in order to lift the dredge 10. A rear hook 25 is secured to the bottom side of the dredge at the rear end. A rear pulling cable 29 is connected to the rear hook 25, and is used to pull the dredge 10 in a rearward direction opposite to the front pulling cable 28. A cutout portion 27 is located in the door 14. The cutout section 27 will allow the door 14 to open without being stopped by the rear hook 25.

Figure 9:
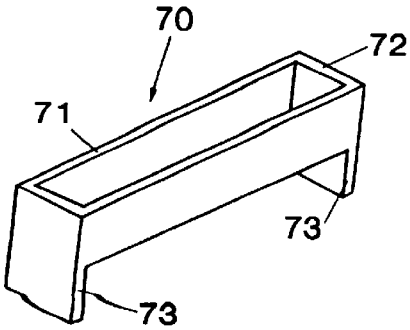
FIG. 9 shows an isometric view of the boot used to support the A-frame when it is pivoted to raise the front end of the dredge.

Mounted on the top side of the dredge are two boots 70. The boots 70 as shown in FIG. 9 are shaped as open-ended boxes having side walls 71 and end walls 72, and a bottom. Legs 73 extend downward from the bottom. The boot is used to provide a support for the ends of the A-frame 17 when the A-frame is pivoted into position. Without the boots 70, the ends of the A-frame would dig into the riverbed, and the dredge would not be raised. The boots are each preferably made of ½ inch thick metal walls, and have a dimension of six feet in length, twelve inches in height, and twelve inches in width. The legs extend six to eight inches downward, and have a thickness of about one inch. The boots are removably fastened to the top of the dredge so that they can be removed when the dredge is caught up against an obstruction such as a rock.

The height of the front end of the dredge 10 is approximately thirty to thirty three inches, while the rear end at the door opening is approximately thirty six inches. The difference in height provides a slight incline in the top and bottom sides of the dredge, which will allow for the contents inside the dredge to easily fall out through the opened door 14 without sticking the inside walls of the dredge 10. The bottom side is also slightly longer in length than the topside of the dredge 10. The purpose for this is to force the door 14 to its closed position without requiring the door to be in an exact vertical position. The force of gravity —when the dredge is supported on a relatively flat surface on the bottom side—acting to pivot the door will be zero when the door is hanging in a pure vertical position. By slightly offsetting this 5 to 10 degrees, the gravitation force or weight of the door will still be acting to force the door up against the rear side of the dredge 10. The door 14 is also biased by a spring (not shown) into the closed position. This will also aid in closing the door to the locked position. Because the door 14 is so heavy, the spring will not keep the door closed when the dredge is in the vertical orientation. The weight of the door 14 will overcome the closing bias of the spring.

Figure 11A:
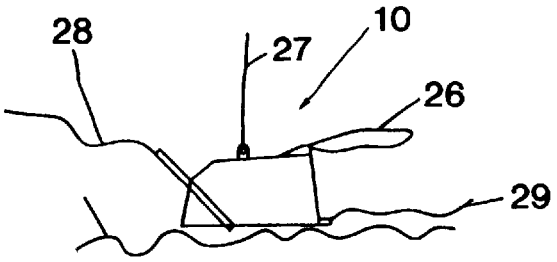
FIGS. 11*a*–11*g* shows the steps used to fill and empty the dredge.
Figure 11B:
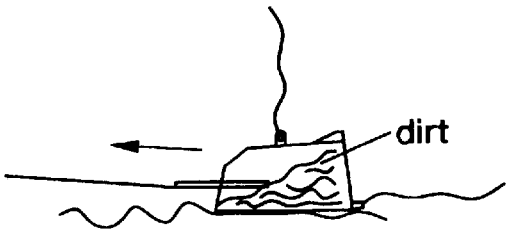
Figure 11C:
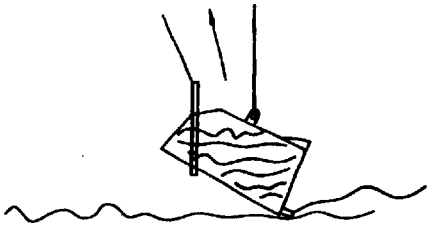
Figure 11D:
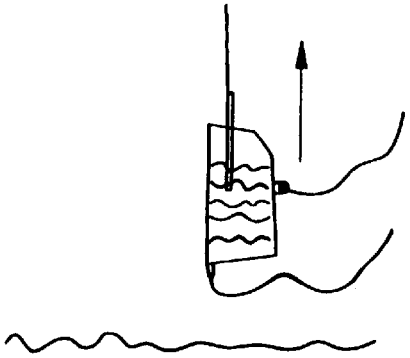
Figure 11E:
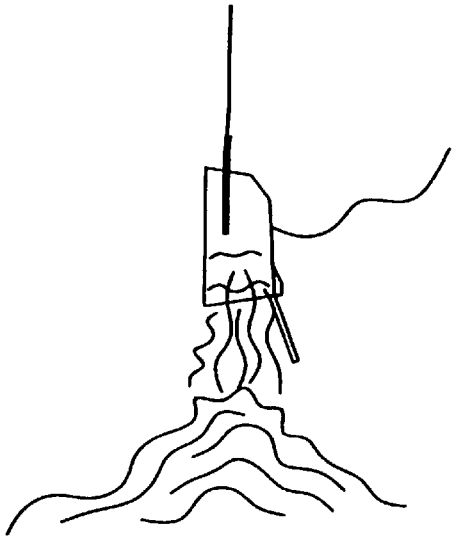
Figure 11F:
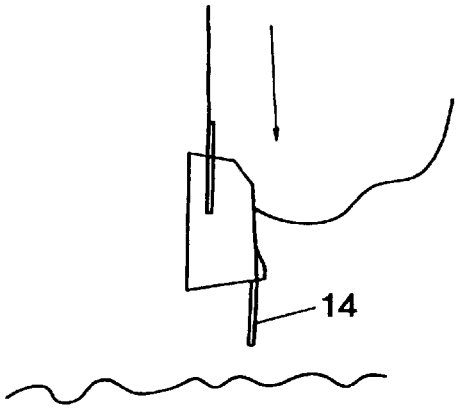
Figure 11G:
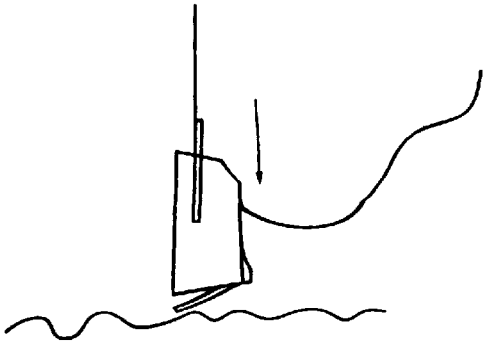

Operation of the dredge 10 is shown in FIGS. 11*a* through 11*g*. Up to four cables can be connected to the dredge at the same time, depending on the desired operation. A front cable 28 is connected to the A-frame hook 21, and is used to pull the dredge along the surface of the soil. A lifting cable 27 is connected to the two lifting hook flanges 18. The lifting cable 27 can be connected via a vertical bar such that the cable 27 is connected to the center of the vertical bar while the ends of the bar are connected by shorter cables to the two lifting hook flanges 18. A rear cable 29 can be connected to the rear end hook member 25, and is used to pull the dredge 10 in reverse or in the opposite direction to that of the front cable 28. An unlocking cable 26 is connected to the unlocking bar 40 on the locking hinge assembly 30, and is used to release the locking latch 16 such that the door 14 can be opened. In operation, the dredge is lowered by the lifting cable 27 in a horizontal position (the bottom side of the dredge is parallel to the surface) and positioned on the surface to be dredged as shown in FIG. 11*a*. The front cable 28 is then used to pull the dredge along the surface as shown in FIG. 11*b* such that the soil on the riverbed or channel is collected in the dredge as contents. When the operator of the dredge 10 has reason to believe that the dredge is full of the contents, then the dredge is raised by using the raising cable 27 with or without the aid of the front cable 28 as shown in FIG. 11*c*. The two lifting hook flanges 18 can be positioned on the dredge 10 toward the rear of the center of gravity such that the dredge will tilt toward the rear end when lifted. Or, the volume in the rear half can be greater than the volume in the front half such that the contents will be greater in volume in the rear half to produce the rearward tilting of the dredge 10 when the cable 27 raises the dredge 10. If preferred, the front cable 28 can lift the dredge 10 such that the dredge is positioned with the rear end toward the ground as shown in FIG. 11*d*. In this position, when the dredge 10 is positioned over the drop site (where the contents are to be emptied), the dredge is oriented in such a way that the contents will be easily discharged when the door 14 is opened. When positioned over the drop zone, the unlocking cable 26 is pulled to release the locking latch 16 such that the door 14 will fall open as shown in FIG. 11*e*. When its contents have been emptied, the dredge 10 is then slowly lowered (FIG. 11*f*) to make contact with the ground such that the door will be closed by the contact of the dredge with the ground as shown in FIG. 11*g*. The dredge 10 is then lifted by the lifting cable 27 and lowered into position on the lake or river bed as shown in FIG. 11*a*.

Figure 13A:
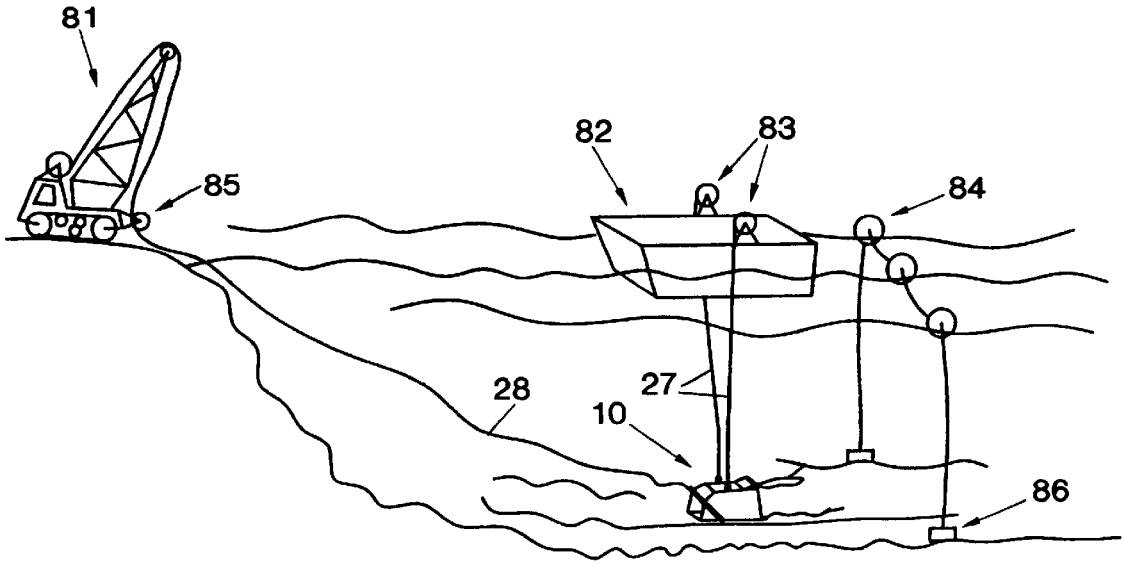
FIGS. 13*a* and 13*b* show the operation of the dredge device as used by a crane and a barge.
Figure 13B:
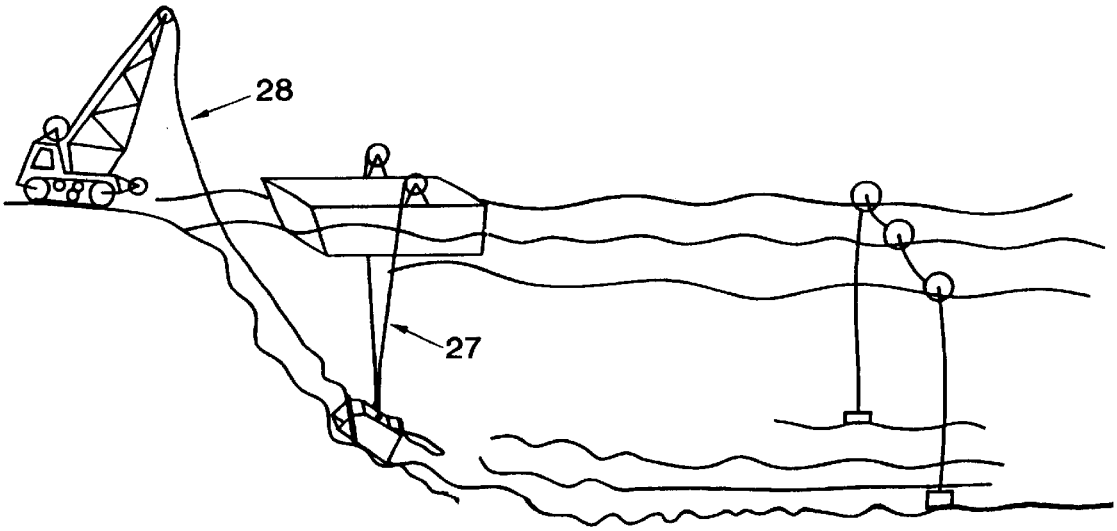

FIGS. 13*a* and 13*b* show the operation of the dredge device under the controls of a crane 81 and a barge 82. The crane 82 would be positioned on the shore of the body of water to be dredged. The crane 82 would be connected to the front cable 28 that is connected to the A-frame. The boat or barge 82 having a winch 83 on each side would be connected to the raising cables 27 to lift and lower the dredge 10 into position. The rear cable 29 would not be needed in this operation. The barge 82 would position the dredge 10 over the desired spot and lower the dredge 10 into position. A line of floating markers 84 is positioned at the far end of the dredging site to mark the spot. The floating markers are anchored by weights 86. The crane 81 would then pull in the front cable 28, dragging the dredge 10 along the surface to be dredged. When the crane 81 is pulling the dredge 10 along the riverbed, the cable 28 is placed over a pulley 85 on the bottom of the crane 81. As the crane is pulling in the front cable 28, the winches 83 on the barge 82 would let out the lifting cable 27 or the barge would follow the dredge toward the shore and crane. When the dredge is full, the barge would then be used to lift the dredge close to the shore near the crane. The lifting cables 27 are then removed from the dredge, the pulling cable 28 is removed from the pulley 85 on the crane, and the crane lifts the dredge out of the water by pulling in cable 28. When the dredge 10 has been emptied on shore, the lifting cables 27 are again attached to the dredge, and the dredge is lowered into the water near the shore. The barge then lifts the dredge by the lifting cables 27 and carries the dredge back towards the floating markers for a repeat of the dredging activity.

In another operation, only the front and rear cables 28 and 29 are needed. A first crane can be located on a first side of the river and is connected to the dredge 10 by the front cable 28. A second crane or a bulldozer having a winch can be positioned on the opposite side of the river and connected to the dredge 10 by the rear cable 29. The lifting cable 27 would not be needed. The unlocking cable 26 used to release the door can be left hanging from the dredge such that a person on the ground near the drop site can pull on the unlocking cable 26 to release the door 14. The second crane would use the rear cable 29 to pull the dredge 10 into place on the riverbed. The first crane would then pull the dredge by the front cable 28 along the riverbed in order to fill the dredge with the river bed contents. If the first crane is tall enough, when the dredge 10 reaches close to the riverbank, the dredge will be lifted into the air and off of the ground. The dredge 10 along with its contents would then be hanging as shown in FIG. 11*d*. The first crane would then position the dredge over the drop site and an operator would pull on the unlocking cable 26 to release the door 14. The first crane would then move the dredge 10 to a position away from the drop site and lower the dredge onto the ground to close and lock the door 14. Once locked, the second crane would pull the dredge via the rear cable 29 into position on the riverbed in order to restart the dredging process.

Figure 10A:
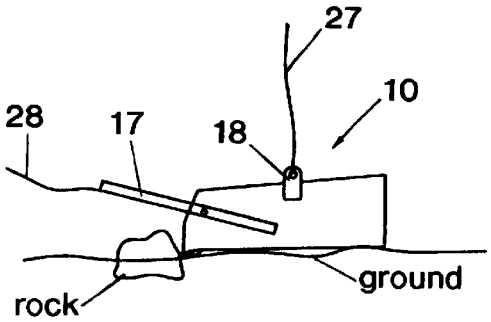
FIGS. 10*a*–10*d* shows the steps used to raise the front end of the dredge up and over an obstruction such as a rock.
Figure 10C:
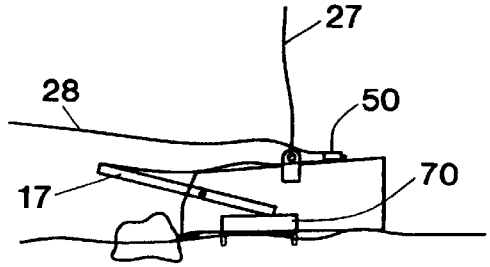
Figure 10B:
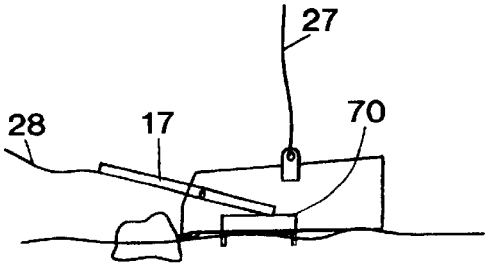
Figure 10D:
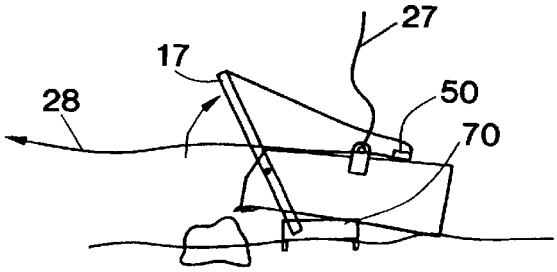

In the event that the dredge 10 comes to rest against an obstruction such as a rock (FIG. 10*a*) on the river bed, the A-frame assembly 17 is used to raise the front of the dredge to a height such that the dredge can pass over the rock. When the rock is encountered as shown in FIG. 10*b*, a diver would swim down to the submerged dredge and remove the boots 70 from the top surface of the dredge, and place the boots 70 on the riverbed surface along the sides of the dredge. The diver would also place the front cable 28 over the pulley 50. The boots 70 provide a support for the rear ends of the A-frame 17 in order that the ends do not sink into the riverbed surface when the A-frame is pivoted. With the front cable 28 placed over the pulley assembly 50, pulling on the front cable 28 will cause the A-frame assembly 17 to pivot from the position shown in FIG. 10*c* to that shown in FIG. 10*d*. The front end of the dredge 10 is thus raised up over the rock or obstruction on the riverbed. The boots 70 support the A-frame 17 as it is pivoted. When the dredge has been successfully raised above the rock, the front cable is removed from the pulley assembly 50, and pulling on the front cable 28 then pulls the dredge over the rock. The boots 70 are then placed back on the dredge.

The dredge 10 is formed of steel plate section welded together by conventional means. The thickness of the plates used would depend upon the overall size of the dredge. A larger dredge in the 300 cubic feet volume range would require thicker steel plates than would a smaller dredge of about 100 cubic feet in volume. L-shaped channel members can be added to the steel plates to reinforce the dredge. The L-shaped channels would be added to the inside surface of the bottom side and the left and right sides, while the channels would be placed on the top surface of the topside. The lightest but strongest dredge design would use thinner steel plates reinforced with L-shaped channels. The teeth 27 located on the lower edge of the front side would preferably be made of hardened steel, and be triangular shaped with three-inch sides. Each tooth would preferably be mounted to the dredge separately such that a broken tooth could be replaced individually.

I claim:

1. A dredge device for scooping soil from a riverbed, comprising:

A bottom side;

A top side;

A left side;

A right side;

A front side and a rear side, both of which are opened;

A door pivotally connected to the rear side;

Releasable locking means secured to the dredge for holding the door in a closed position;

A pully assembly secured to the top side of the dredge and near the rear side;

The pulley assembly including a bottom plate secured to the top side of the dredge;

A pivot plate pivotally secured to the bottom plate;

A pulley rotatable secured to the pivot plate; and

The bottom plate includes a pair of angled portions positioned substantially adjacent the pulley, the angled portions acting to hold a cable on the pulley when the pivot plate is pivoted away from the bottom plate and acting to allow the cable to be removed when the pivot plate is pivoted toward the bottom plate.

2. The dredge of claim 1, and further comprising;

A pivot point on each of the left side and the right side; and,

A frame member pivotally connected to the dredge at the pivot points, the frame member having a pair of legs of a predetermined length such that the legs extend below the bottom side of the dredge when the frame member is positioned in a vertical orientation with respect to the dredge.

3. The dredge of claim 1, and further comprising;

A removable blade attached to a bottom portion of the front side of the dredge.

4. The dredge of claim 1, and further comprising;

The releasable locking means including:

A locking hinge secured to the dredge;

A spring to bias the locking hinge;

An overhang portion attached to the locking hinge and having an engaging portion for engaging a portion of the door; and, Means to pivot the locking hinge against the bias of the spring.

5. The dredge of claim 4 and further comprising;

The overhang portion having a tip extending toward the door; and,

A groove located on an outer surface of the door, the tip engaging the groove when the door is closed.

6. A dredge device for scooping soil from a riverbed, comprising:

A bottom side;

A top side;

A left side;

A right side;

A front side and a rear side, both of which are opened;

A door pivotally connected to the rear side;

Releasable locking means secured to the dredge for holding the door in a closed position;

The releasable locking means including:

A locking hinge secured to the dredge;

A spring to bias the locking hinge;

An overhang portion attached to the locking hinge and having an engaging portion for engaging a portion of the door;

Means to pivot the locking hinge against the bias of the spring; and

The means to pivot the locking hinge against the bias of the spring being a rectangular bar with arms extending from the ends of the bar, the bar having a cross-sectional width substantially greater that a cross-sectional height, the bar being positioned between the top side of the dredge and the locking hinge.

7. The dredge of claim 6, and further comprising;

A plurality of busing secured to the top side of the dredge, the rectangular bar being held between the bushings.

8. The dredge of claim 7, and further comprising;

The hinge and the overhand portion of the door lock having a length substantially equal to the width of the door.

9. The dredge of claim 7, and further comprising;

A pair of hook members each secured to the sides of the dredge, the hook members being positioned at the center of gravity of the dredge along the sides.

10. The dredge of claim 9, and further comprising;

A front hook member attached to the frame member; and,

A rear hook member attached to a rear portion of the bottom side of the dredge.

11. The dredge of claim 7, and further comprising;

A rear hook member attached to a rear portion of the bottom side of the dredge; and, A cutout portion in the door and positioned substantially adjacent the rear hook member, the cutout portion having an area greater than an area of the rear hook member.

* * * * *